US005898363A

United States Patent [19]

Altilio

[11] Patent Number: 5,898,363

[45] Date of Patent: Apr. 27, 1999

[54] PORTABLE AUDIBLE BEACON

[75] Inventor: Michael T. Altilio, Staten Island, N.Y.

[73] Assignee: Safety Systems, Inc., Staten Island, N.Y.

[21] Appl. No.: 08/811,199

[22] Filed: Mar. 5, 1997

[51] Int. Cl.[6] ..... G08B 3/00

[52] U.S. Cl. ..... 340/384.1; 340/286.05; 340/321; 340/326; 340/539; 340/573

[58] Field of Search ..... 340/384.1, 573, 340/539, 326, 328, 329, 331, 332, 286.05, 321

[56] References Cited

U.S. PATENT DOCUMENTS

| | | | |
|---|---|---|---|
| 3,638,011 | 1/1972 | Bain et al. | 340/321 |
| 3,818,428 | 6/1974 | Phipps et al. | 340/321 |
| 3,942,176 | 3/1976 | Bright | 340/416 |
| 3,969,720 | 7/1976 | Nishino | 340/371 |
| 4,090,185 | 5/1978 | Patty | 340/321 |
| 4,241,332 | 12/1980 | Farque | 340/326 |
| 4,254,405 | 3/1981 | Wenzlaff | 340/321 |
| 4,283,657 | 8/1981 | Gordon et al. | 315/86 |
| 4,287,509 | 9/1981 | Beggs | 340/326 |
| 4,288,784 | 9/1981 | Fusco | 340/326 |
| 4,468,656 | 8/1984 | Clifford et al. | 340/539 |
| 4,499,453 | 2/1985 | Right | 340/326 |
| 4,600,914 | 7/1986 | Walsh | 340/286 |
| 4,631,517 | 12/1986 | Ajland | 340/326 |
| 4,746,912 | 5/1988 | Clifford et al. | 340/691 |
| 4,821,026 | 4/1989 | Newson | 340/574 |
| 4,847,589 | 7/1989 | Dobblins | 340/326 |
| 4,904,982 | 2/1990 | Lieb et al. | 340/326 |
| 4,926,159 | 5/1990 | Bartlett | 340/384 |
| 4,959,637 | 9/1990 | Woods et al. | 340/573 |
| 4,967,177 | 10/1990 | Nguyen | 340/326 |
| 4,980,837 | 12/1990 | Nunn et al. | 364/484 |
| 5,012,221 | 4/1991 | Neuhaus et al. | 340/384.1 |
| 5,028,911 | 7/1991 | Wanat et al. | 340/691 |
| 5,075,671 | 12/1991 | Livingston, III | 340/574 |
| 5,121,096 | 6/1992 | Moore et al. | 340/326 |
| 5,132,659 | 7/1992 | Kuo | 340/326 |
| 5,216,418 | 6/1993 | Lenz et al. | 340/815.21 |
| 5,317,305 | 5/1994 | Campman | 340/573 |
| 5,648,753 | 7/1997 | Martin | 340/384.3 |

*Primary Examiner*—Nina Tong

*Attorney, Agent, or Firm*—Baker & Botts, L.L.P.

[57] ABSTRACT

A portable audible beacon comprises a housing that encloses a signal generating means and an acoustic transducer. The signal generating means generates an oscillating signal that is periodically interrupted by a zero signal, where the fundamental frequency of the oscillating signal corresponds to a frequency of high auditory sensitivity to the human ear, where the frequency of interruption of the oscillating signal corresponds to a directionally discernible frequency to the human ear, and where the period of duration of each zero signal is less than or about the same as the period of duration of the oscillating signal between each zero signal. The acoustic transducer receives the signal from the signal generating means and converts it into sound. The portable audible beacon of the present invention achieves the combined advantages of power efficiency, auditory sensitivity, and directionality.

20 Claims, 5 Drawing Sheets

PORTABLE AUDIBLE BEACON

BACKGROUND OF THE INVENTION

This invention relates to a portable, audible beacon and, more specifically, to a portable, audible beacon which may be positioned at the exit of a building and used by firefighters and emergency service personnel as a directional guide to find their way out of the building in heavy smoke conditions.

Firefighters and other emergency service personnel are often required to operate inside buildings filled with heavy smoke. Under such conditions, the firefighters and emergency service personnel may become disoriented and lose their way to the exit of a building. Because of the limited air supply available to them or because of other dangerous conditions within the buildings, such disorientation is often a life-threatening matter for these personnel.

In the past, to assist guiding firefighters in exiting a building, some firefighting units have positioned a firefighter at the exit of a building to signal the firefighters inside. The firefighter at the exit either used a flashlight to provide a visual signal or shouted to provide an audible signal to the firefighters in the building.

This approach, however, has the following disadvantages. Primarily, it is an ineffective means of signaling. The use of a flashlight is ineffective because the light generated by a flashlight is unable to penetrate heavy smoke. Likewise, shouting is also ineffective because a person's shout is unable to be heard throughout a large building, especially amid the noise and chaos of a structural fire. Additionally, shouting is dangerous because a firefighter must remove his mask to shout effectively to his fellow firefighters, thus exposing himself to smoke inhalation and toxic gases. Moreover, posting a firefighter at the exit of a building is ineffective because the firefighter may be unable to remain at his station. The firefighter may be overcome by smoke or heat or may perceive a greater need for his help at another location. Further, posting a firefighter at the exit of a building is inefficient because it reduces the personnel available to fight a fire and to perform search and rescue operations. Finally, posting a firefighter at the exit of a building may be unnecessarily dangerous because it exposes the firefighter to the same dangerous conditions as the firefighters who have entered the building (such as building collapse, falling debris, radiant heat, and flames).

Another approach to assisting firefighters in smoke-filled conditions has been the use of personal alert safety systems or "PASS" devices. Such devices have been disclosed, for example, in U.S. Pat. Nos. 5,317,305 (Campman); 5,216,418 (Lenz); 4,926,159 (Bartlett); 4,468,656 (Clifford); and 4,090,185 (Patty). In general, PASS devices are portable devices carried or worn by firefighters which sound an alarm either automatically (under certain specified emergency conditions) or manually. The PASS alarm assists other firefighters in locating a firefighter in distress.

Unfortunately, the use of PASS devices focuses on bringing rescuers to a lost or injured firefighter. The PASS approach puts the rescuers in the same danger as the firefighter they are attempting to rescue. For this reason, an audible exit beacon is preferable to a PASS device because such a beacon could prevent a firefighter from becoming disoriented, lost and/or injured in the first place.

While technically a PASS device could be used as an audible exit beacon (by placing the PASS device at the exit of a building and initiating its alarm condition), a PASS device is not well-suited to performing the functions of an audible exit beacon. Because of the size and weight restrictions inherent in a device that must be conveniently carried by a firefighter on his person, PASS devices do not have sufficient power to project sound effectively throughout a large building. Furthermore, a device that is small enough to be conveniently carried by a firefighter on his person could easily become immersed in water or covered by a small amount of fallen debris. Under such conditions, it would be impossible for sound to emanate from the device, rendering it useless.

Another major problem typical of most PASS devices and the prior art in general has been the inability to combine power efficiency, auditory sensitivity, and directionality of sound in one device. Until now, audible beacon devices have not been able to combine all of these features because of the inherent design constraints arising from the physiology of human hearing.

One of the most important ways people determine the direction of distant sounds is by detecting the difference in the phase of the sound waves received by the two ears. This method becomes ineffective, however, when the wavelength of a sound approaches or becomes shorter than the distance of separation between the two ears. For adult humans, the directionality of a sound is usually lost when the frequency of the sound exceeds 2000 Hz (corresponding to a wavelength of under seven inches).

Within the range of normal human hearing (which is about 16 Hz to 20 KHz), the human ear is more sensitive to certain frequencies than to others. In particular, the sensitivity of the human ear is greatest at a frequency of about 2700 Hz, and it decreases as one gets further and further away from this peak frequency. The result of the human ear's varying sensitivity to different frequencies is that, at a given power level, some frequencies sound louder than others. For example, if a 2700 Hz sound and a 64 Hz sound are projected at the same power level, the 2700 Hz sound has an apparent loudness to a human ear of about 16 times greater than the 64 Hz sound. Conversely, to achieve the same apparent loudness of a 2700 Hz sound, a 64 Hz sound would require about 100,000 times more power than a 2700 Hz sound. Unfortunately, therefore, sounds that are directionally perceptible to humans are much more "power-hungry" than sounds that are not directionally perceptible.

Although not as constrained with respect to size and weight as PASS devices, an audible exit beacon must take these factors into consideration to be useful. The size and weight of an audible exit beacon cannot be so great as to render such a device non-portable. Portability of an audible exit beacon is essential to the firefighters who need to easily carry the beacon to the different buildings at which they are called to work. In addition, it is generally desirable to have an efficient power consumption so that an audible exit beacon can operate for as long a time as possible before its power source is exhausted. The longer the life of an audible exit beacon's power source, the less likely the possibility that the exit beacon will stop operating while firefighters are working. Such an interruption in operation would be, at the very least, an inconvenience and annoyance (since a firefighter would be diverted from his duties to replace the power source) and could possibly be dangerous under certain circumstances (for example, if the unit stopped operating while firefighters were attempting to escape from dangerous conditions).

One of the patent references cited earlier, Bartlett, discloses a device that attempts to overcome the trade-off between power efficiency, auditory sensitivity, and directionality of audible devices. Bartlett discloses a device that drives a resonant piezoelectric element by a frequency-modulated electrical input. The piezoelectric element resonates at a frequency of about 3000 Hz (a power-efficient frequency). Because of its resonant character, the piezoelectric element generates an amplitude-modulated sound output from the frequency-modulated electrical input. This amplitude-modulated sound output is characterized in Bartlett as a burst of 3000 Hz sound that lasts less than 1 millisecond and that is repeated about every 2 milliseconds. By using bursts of a power-efficient frequency, spaced apart so that the bursts are directionally perceptible, Bartlett's device purportedly achieves both power efficiency and directionality.

Bartlett's device, however, is not suitable for use as an audible exit beacon device. Bartlett's use of a piezoelectric device limits the power output of the device to a range that is unacceptable for audible exit beacons. Typically, portable piezoelectric devices operate in the milliwatt power range. For sound to be heard throughout a large building, an audible device must typically deliver tens of watts of power. Moreover, because of the resonating scheme used in Bartlett, one can not simply replace the piezoelectric device with a more powerful acoustic transducer, such as a loudspeaker, since such a transducer is not normally a resonator. Thus, the frequency modulation of the driving signal to a loudspeaker will not normally result in an amplitude modulation of an audible output signal. Finally, another disadvantage of Bartlett's scheme is that the device delivers output power during less than 50 percent of its cycle time.

SUMMARY OF THE INVENTION

The present invention is directed to a portable audible beacon that, for the first time, achieves the combined advantages of power efficiency, auditory sensitivity, and directionality and that is capable of being heard throughout a large building and of functioning in the harsh conditions of a firefighting operation. A portable audible beacon according to the present invention comprises a housing that encloses a signal generating means and an acoustic transducer. The signal generating means generates an oscillating signal that is periodically interrupted by a zero signal, where the fundamental frequency of the oscillating signal corresponds to a signal of high auditory sensitivity to the human ear, where the frequency of interruption of the oscillating signal corresponds to a directionally discernible frequency to the human ear, and where the period of duration of each zero signal is less than or about the same as the period of duration of the oscillating signal between each zero signal. The acoustic transducer receives the signal from the signal generating means and converts it into sound.

Preferably, the oscillating signal has a fundamental frequency between the range of 2000 Hz to 3000 Hz and the frequency of interruption of the oscillating signal is 50 Hz to 500 Hz. In a preferred embodiment, the frequency of the oscillating signal is 2500 Hz, the frequency of interruption of the oscillating signal is 125 Hz, the period of duration of each zero signal is 0.0004 second, and the period of duration of the oscillating signal between each zero signal is 0.0076 second.

In this preferred embodiment, the sound generated by the acoustic transducer is a train of 2500 Hz sound waves with a sound wave "skipped" after each nineteenth wave. The frequency of the "skipped" waves (i.e., the frequency of the periods of silence) is 125 Hz (2500 Hz divided by twenty, the number corresponding to nineteen sound waves plus one "skipped" wave or period of silence).

Remarkably, using this sound pattern, it has been found that listeners perceive a sound tone of 125 Hz, which is not really there, instead of a sound tone of 2500 Hz. Even more remarkable, this perceived 125 Hz tone has the directional characteristics of a real 125 Hz tone—that is, the train of "skipped" waves exhibits the same phase difference properties when perceived by a person's ears as does a real 125 Hz tone—but because the perceived tone is produced by utilizing a 2500 Hz tone, the perceived 125 Hz tone also has the power efficiency and auditory sensitivity of a 2500 Hz tone. Accordingly, through the use of a specially synthesized sound, the portable audible beacon of the present invention achieves the combined advantages of the directionality of low-frequency sound and the auditory sensitivity and power efficiency of high-frequency sound.

Another preferred embodiment of the portable audible beacon according to the present invention incorporates the specially synthesized sound as part of another sound pattern. Specifically, this second preferred embodiment utilizes four, one-quarter second periods of the specially synthesized sound alternated with four, one-quarter second periods of silence followed by an eight second period of silence. The periods of silence between the periods of specially synthesized sound allow echoes within a building to die down, and the eight second period of silence allows firefighters to hear voice commands or cries for help.

Preferably, the portable audible beacon of the present invention includes two sound ports so that if the unit is knocked over or pushed against a wall, the possibility of blockage of sound is reduced. The sound ports consist of grille portions in the front and side panels of the housing of the unit.

Preferably, the portable audible beacon of the present invention includes a side handle mounted on a side panel with a sound port. The side handle acts as a standoff for the sound port on the side panel and causes the portable audible beacon to be dynamically unstable and tip over when it is placed down on its side panel. Thus, the side handle further reduces the possibility of sound blockage.

Preferably, the portable audible beacon of the present invention includes a waterproof, flexible, heat-resistant membrane enclosing the acoustic transducer, which allows the transducer to operate when the transducer is partially submerged in water.

Preferably, the portable audible beacon of the present invention includes a radio receiver, which can be used to switch between two distinct audible beacons. One of the audible beacons may be used as a normal-condition exit beacon, and the other audible beacon may be used as an evacuation signal, which alerts firefighters and emergency workers within a building to exit immediately.

Preferably, the portable audible beacon of the present invention also includes a strobe light, a carrying handle, and a rechargeable power source.

These and other features, aspects, and advantages of the present invention will become better understood with regard to the following detailed description, appended claims, and accompanying drawings.

DETAILED DESCRIPTION

Figure 1:
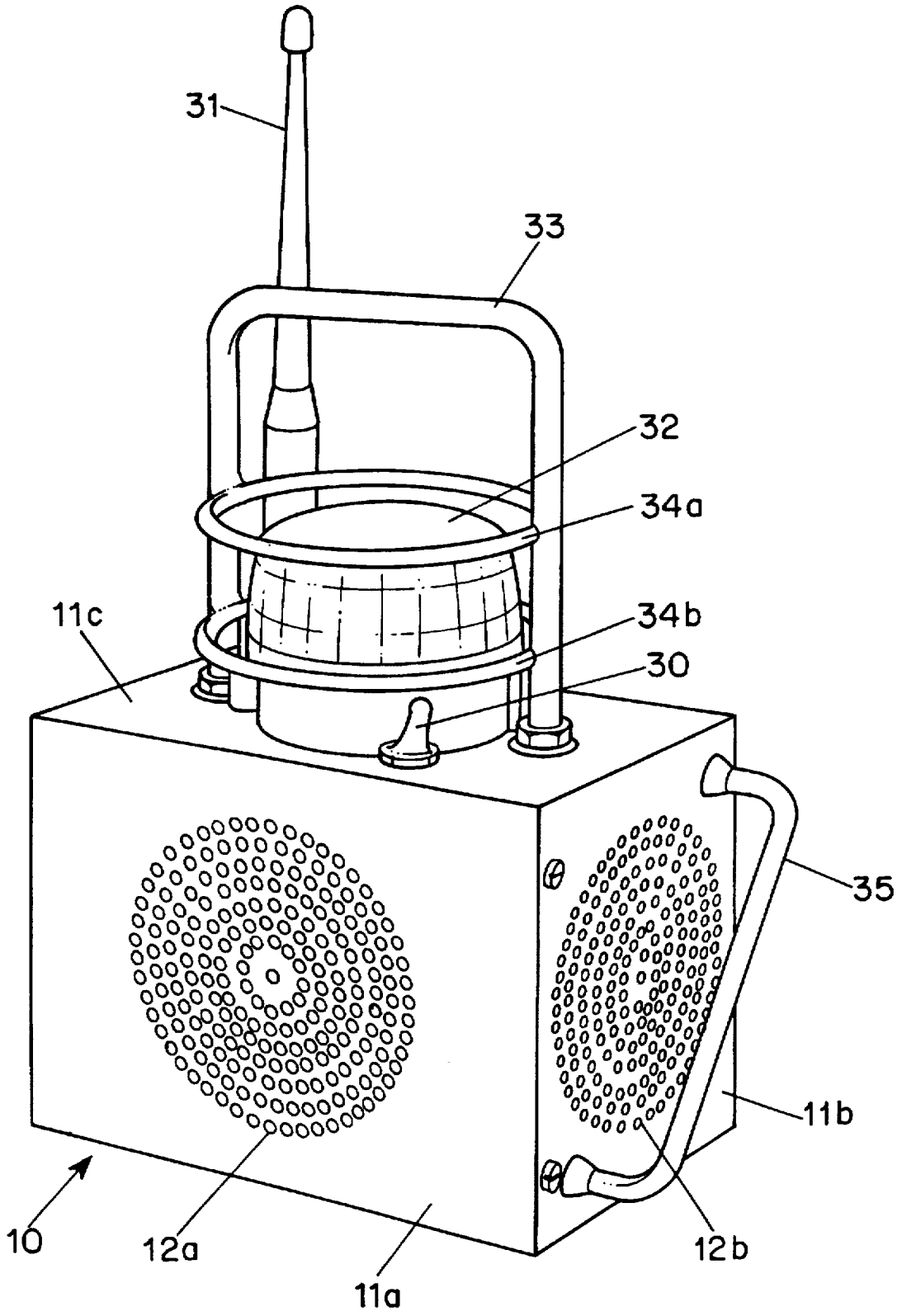
FIG. 1 is a three-dimensional perspective view of a preferred embodiment of the present invention.

As shown in the drawings, a preferred embodiment of an audible beacon according to the present invention includes a housing 10 that encloses a power source 20, a control circuitry 21, and a loudspeaker 22. A power switch 30, a radio antenna 31, a strobe light 32, and a carrying handle 33 are mounted to a top panel 11*c* of the housing 10. Preferably, the strobe light 32 is mounted between the carrying handle 33 and two circular guards 34*a* and 34*b*, which are mounted to the inside edge of the carrying handle 33.

A front panel 11*a* and a side panel 11*b* of the housing contain two grille portions 12*a* and 12*b*, respectively, which function as sound ports allowing the conveyance of sound from the loudspeaker 22 inside the housing to the space outside the housing. The use of two sound ports reduces the risk that the audible beacon of the present invention will become inaudible as a result of the unit being knocked over or being pushed against a wall, a not unlikely occurrence in the chaotic conditions under which firefighters frequently operate.

To further reduce the possibility of blockage of sound, a side handle 35 is mounted onto the side panel 12*b* and serves as a standoff for the sound port on the side panel. Preferably, the side handle 35 is mounted diagonally across the side panel 12*b* and has sufficient height that it makes the unit dynamically unstable when the unit is placed with the side panel 12*b* facing down. In other words, the height of the side handle 35 is such that, when an attempt is made to place the unit down on its side panel 12*b*, the center of mass of the unit causes it to tip over.

It is not uncommon for three to four inches of water to accumulate on the floor of a building in which a fire is being extinguished. To operate under these conditions, a preferred embodiment of the present invention includes a waterproof, flexible, heat-resistant membrane that envelopes the loudspeaker and allows the loudspeaker to emit sound as long as part of the loudspeaker is above water. An unenveloped loudspeaker, even if designed not to be damaged by water, will stop emitting sound as soon as its voice coil is covered by water. Preferably, the protective membrane is a thin film of polyvinylidene fluoride with a thickness ranging between 0.5 mil and 1 mil.

Figure 4:
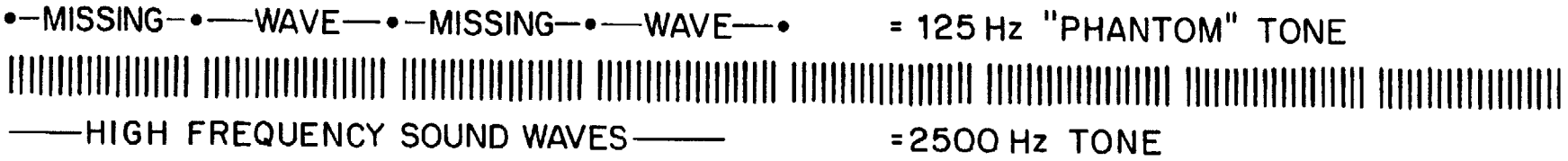
FIG. 4 is a diagram of a preferred embodiment of the audible beacon of the present invention.

To achieve the combined goals of power efficiency, auditory sensitivity, and directionality, the present invention generates a train of high-frequency sound waves that is interrupted with periods of silence at low-frequency intervals. The fundamental frequency of the sound waves corresponds to a frequency of high auditory sensitivity to the human ear and the frequency of the periods of silence corresponds to a directionally perceptible frequency to the human ear. Thus, for example, as shown in FIG. 4, a preferred embodiment of the present invention utilizes a train of 2500 Hz sound waves that is interrupted with a period of silence after every nineteenth sound wave. Thus, a sound wave is "skipped" after every nineteenth sound wave. In this example, the frequency of the "skipped" sound waves or periods of silence is 125 Hz (2500 Hz divided by twenty, the number corresponding to nineteen sound waves plus one "skipped" wave or period of silence).

Remarkably, using this sound pattern, it has been found that listeners perceive a sound tone of 125 Hz, which is not really there, instead of a sound tone of 2500 Hz. Even more remarkable, this perceived 125 Hz tone has the directional characteristics of a real 125 Hz tone, but because it is produced by utilizing a 2500 Hz tone, the perceived 125 Hz tone also has the power efficiency and auditory sensitivity of a 2500 Hz tone. Accordingly, through the use of a specially synthesized sound, the portable audible beacon of the present invention achieves the combined advantages of the directionality of low-frequency sound and the auditory sensitivity and power efficiency of high-frequency sound.

Figure 5:
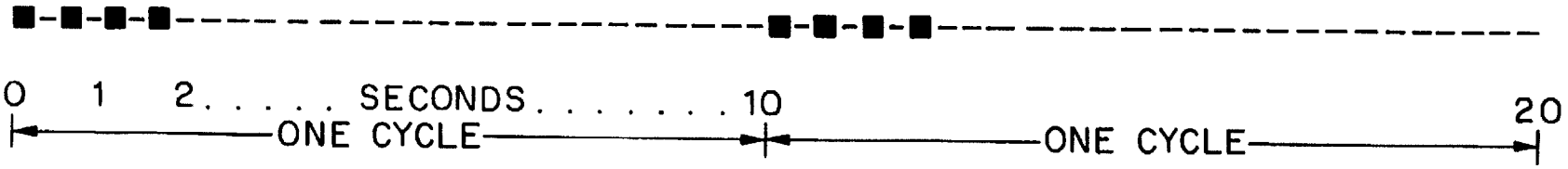
FIG. 5 is a diagram of another preferred embodiment of the audible beacon of the present invention.

FIG. 5 shows another preferred embodiment of an audible beacon according to the present invention. This embodiment incorporates the previously described specially synthesized sound as part of another sound pattern. Specifically, each cycle of this second embodiment is comprised of four, one-quarter second periods of the specially synthesized sound, alternated with four, one-quarter second periods of silence, and followed by an eight second period of silence.

This second embodiment of the present invention addresses the following two concerns. First, if a continuous or continuously pulsing sound is transmitted in a building, it may produce echoes from the walls, staircases, or other internal structures. A person might mistake the direction of an echo as the direction of the original sound and, thus, mistake the direction to an exit. Second, a firefighter must be able to listen for voice commands from other firefighters or for cries of help from victims. Because of the volume required for an audible exit beacon to be heard throughout a large building, a continuous audible exit beacon may drown out these commands or cries for help.

In the second preferred embodiment of the present invention, the specific duration of the periods of sound and silence have been chosen because it has been found that humans can determine a sound's direction within about 0.75 second. Thus, the four, one-quarter second periods of sound spaced relatively closely together provide a sufficient time for a person to determine the direction of an audible exit beacon. The eight second period of silence in the second preferred embodiment provides a window of silence in which a firefighter may listen for important commands and calls; yet, it is not too long a time that a firefighter will be endangered if a dangerous condition arises and the firefighter must exit a building promptly.

Figure 2:
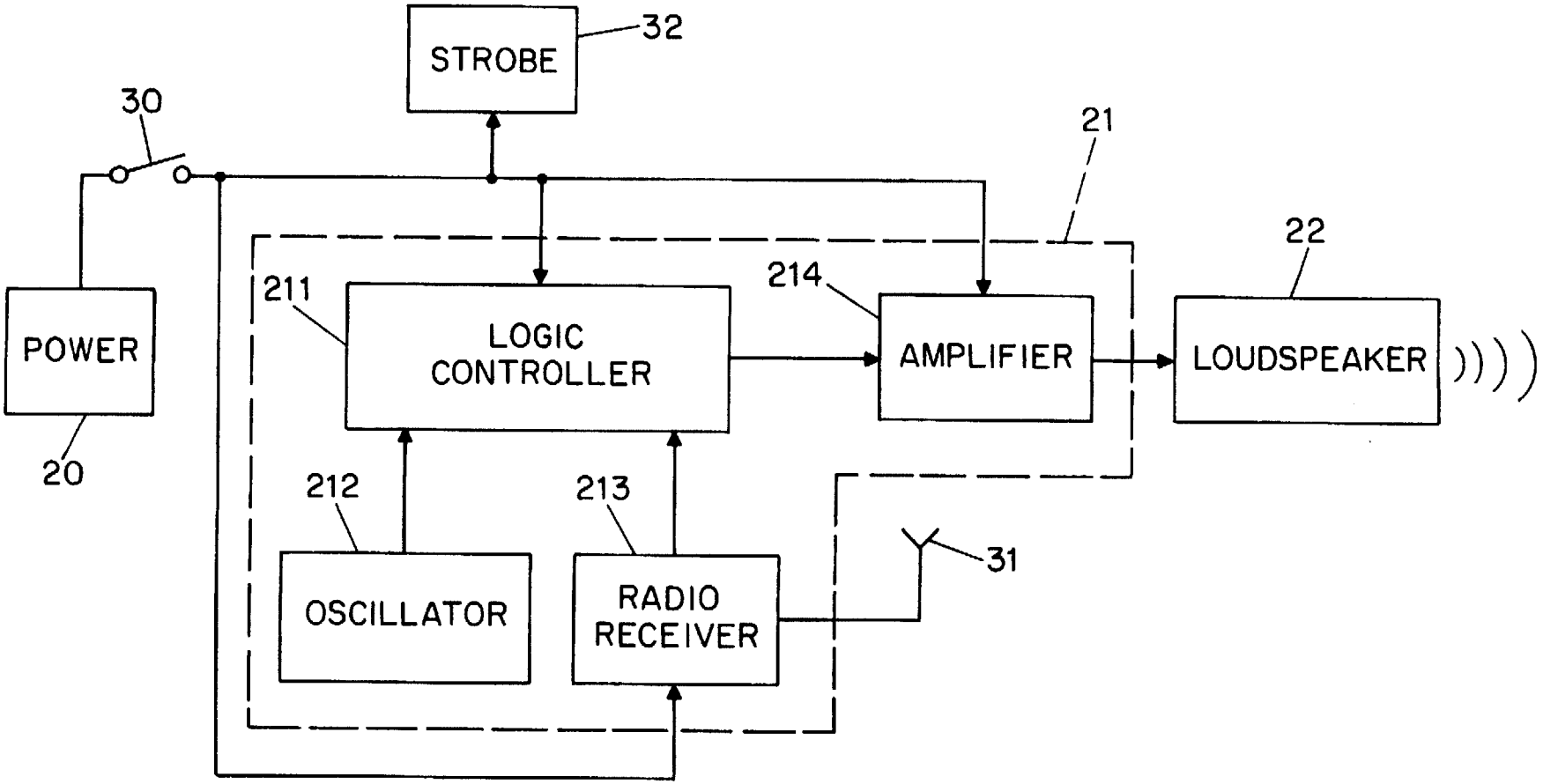
FIG. 2 is a functional block diagram of a preferred embodiment of the electrical circuitry of the present invention.

FIG. 2 shows a functional block diagram of a preferred embodiment of the electrical circuitry of the present invention, which is used to generate the specially synthesized sound pattern described above. The power source 20 provides power to the control circuitry 21 and the strobe light 32. The control circuitry 21 consists of a logic controller 211, which receives an oscillating reference signal from an oscillator 212 and control signals from a radio receiver 213. The radio receiver 213 is connected to radio antenna 31. The output of the logic controller 211 is connected to an amplifier 214, which amplifies the output and drives the loudspeaker 22.

Figure 3:
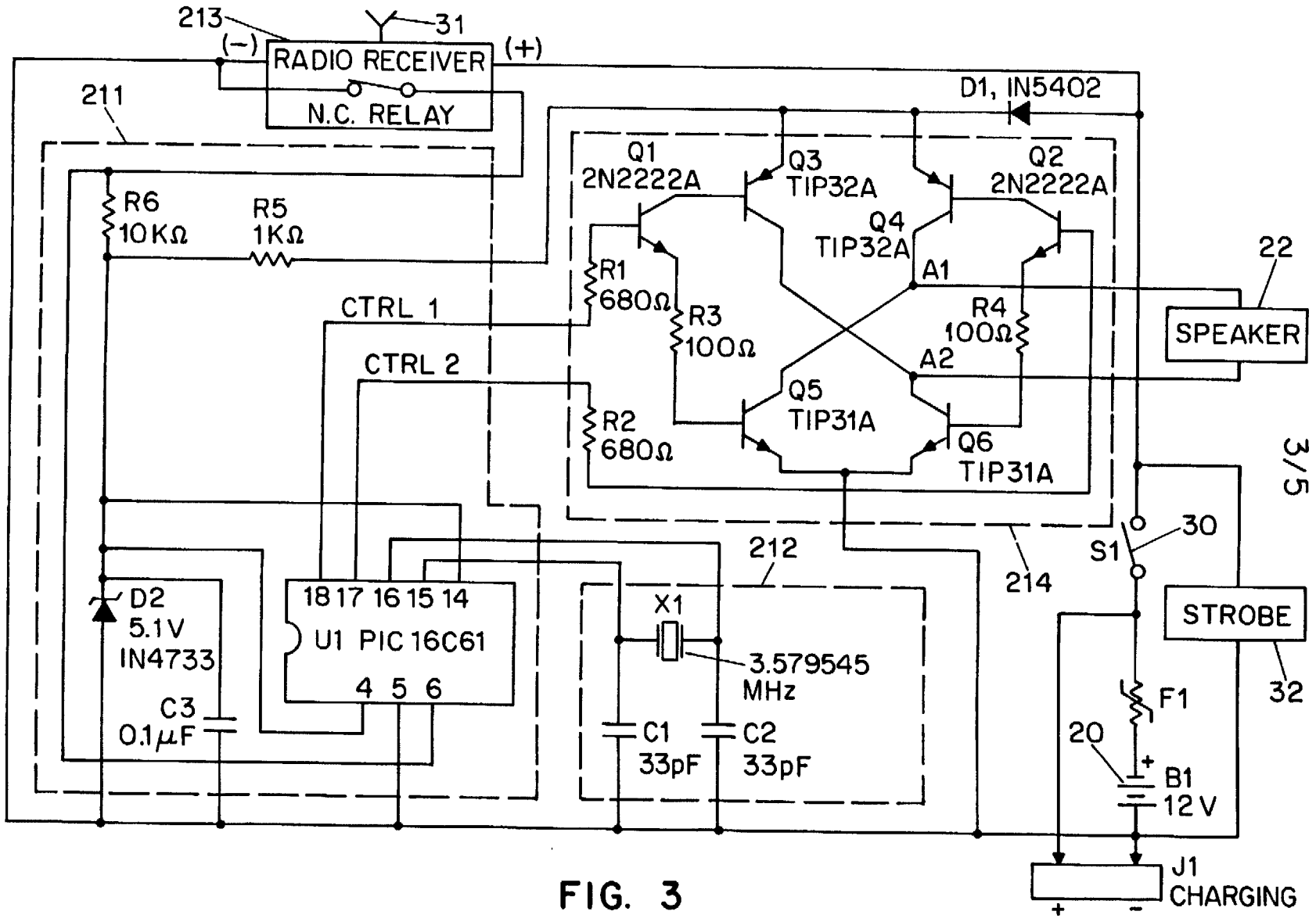
FIG. 3 is a schematic diagram of a preferred embodiment of the electrical circuitry of the present invention.

FIG. 3 shows a schematic diagram of a preferred embodiment of the electrical circuitry of the present invention. The power source 20 (also designated B1 in the diagram) is preferably a 12 volt lead-acid, rechargeable battery with a 1.2 ampere-hour capacity. A charging jack J1 is connected to the power source and allows the periodic recharging of the power source by means of various commercially available battery chargers.

A power switch 30 (also designated S1 in the diagram) is a single-pole, double-throw switch of heavy-duty design. A first terminal of the power switch 30 is connected to the power source 20 through a solid-state fuse F1, which is a current-limiting device that latches into a high-resistance state if the current flowing through it exceeds a predetermined limit and that automatically resets to a low-resistance state when the current drops below the predetermined limit. A second terminal of the power switch 30 is connected to the strobe light 32, the radio receiver 213, and a diode D1.

Both the strobe light 32 and the radio receiver 213 are commercially available units. The strobe light 32 is any commercially available 12 volt, direct-current strobe light with a flashing rate of about 60 to 100 flashes per minute, and the radio receiver 31 is any commercially available programmable receiver that controls the state of a relay in response to the reception of a properly coded radio signal (for example, Part No. WR200 from Visonic Ltd.).

Diode D1 connects the power switch 30 to the logic controller 211 and the amplifier 214. Diode D1 protects the components of these circuits from damage that might result from an accidental, reverse-polarity connection of the power source 20. (Diode D1 is not connected to the strobe light 32 and the radio receiver 213 because these units preferably have their own built-in reverse-polarity protection.)

The logic controller 211 of the control circuitry consists of a programmable microcontroller U1 (preferably, Part No. PIC 16C61 from the Microchip Corporation) and certain auxiliary components—resistor R5, resistor R6, capacitor C3, and zener diode D2. Resistor R5, capacitor C3, and zener diode D2 combine to regulate the power supplied by the power source to the microcontroller U1. Specifically, zener diode D2 shunts to ground any voltage in excess of a predetermined limit (typically, 5.1 volts), resistor R5 limits the current through zener diode D2, and capacitor C3 stabilizes the voltage supplied by the power source and reduces any voltage transients created by the microcontroller U1.

The microcontroller U1 receives inputs from the oscillator 212 and the radio receiver 213. The oscillator 212 consists of a crystal X1 and capacitors C1 and C2, which together provide a stable frequency reference for the microcontroller U1. The radio receiver 213 controls the state of a relay. One terminal of the relay is connected to the ground reference voltage, and the other terminal is connected to microcontroller U1 and resistor R6. Normally, the relay is closed and the microcontroller senses a "logic low" voltage. When the receiver receives a properly coded radio signal, the relay opens and resistor R6 pulls the microcontroller input to the "logic high" voltage of the regulated power supply of the microcontroller. The radio receiver can be used to switch between different modes of operation of the invention.

The microcontroller U1 has two outputs, CTRL1 and CTRL2, which correspond as shown in the embodiment of FIG. 3 to pins 18 and 17 of Part No. PIC 16C61, respectively. These outputs are connected to amplifier 214, which consists of transistors Q1 to Q6 and resistors R1 to R4. Transistors Q1 to Q6 are arranged in a push-pull amplifier configuration as shown, and resistors R1 to R4 are used to limit the base currents of transistors Q1, Q2, Q5 and Q6. The output of the amplifier is a balanced line, designated as A1 and A2, which drives the loudspeaker.

In the amplifier configuration shown, outputs CTRL1 and CTRL2 have only three valid states: both may be low, CTRL1 may be low while CTRL2 is high, or CTRL1 may be high while CTRL2 is low. When both outputs are low, all transistors are turned off and no current flows through the loudspeaker. When CTRL1 is low and CTRL2 is high, Q1, Q3, and Q5 are turned off and Q2, Q4, and Q6 are turned on. Thus, current flows through the loudspeaker from A1 to A2. When CTRL1 is high and CTRL2 is low, Q1, Q3, and Q5 are turned on and Q2, Q4, and Q6 are turned off. Thus, current flows through the loudspeaker from A2 to A1. Therefore, through software control of CTRL1 and CTRL2, the direction and duration of travel of the cone of the loudspeaker may be controlled.

Figure 6:
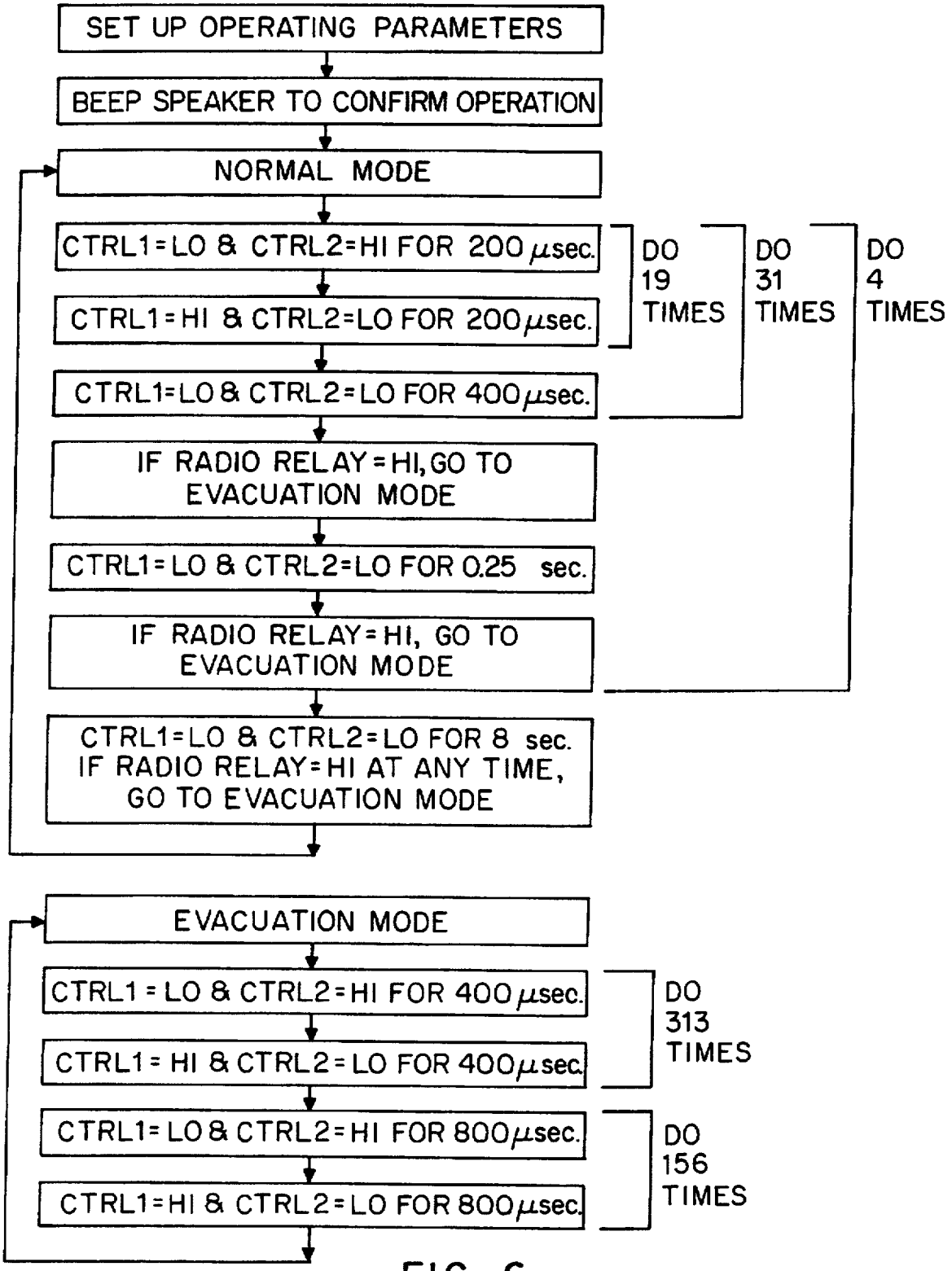
FIG. 6 is a flow chart of the software for generating a preferred embodiment of an audible beacon of the present invention.

FIG. 6 shows a flow chart of the software for the microcontroller U1 for generating a preferred embodiment of the audible beacon according to the present invention. In this example, the timing parameters used for CTRL1 and CTRL2 correspond to a frequency of 2500 Hz for the train of sound waves and a frequency of 125 Hz for the "skipped" sound waves or the periods of silence (and, thus, the frequency of the perceived sound tone).

The example in FIG. 6 also shows the use of the radio receiver to switch between modes of operation. Once a properly coded radio signal is received, the software switches to a second set of timing parameters for CTRL1 and CTRL2, and the unit emits a second audible beacon distinct from the first beacon. This second beacon can be used by a commander or fire chief to order an evacuation of emergency personnel. An evacuation beacon mode separate from a normal-condition exit beacon mode is desirable because oftentimes it is difficult to communicate with all of the firefighters in a burning building effectively as a result of the high level of noise surrounding the firefighting operation or the unreliability of radio communications.

The radio receiver of the present invention is also useful in those situations where it is preferable to emit no sound until conditions require an immediate evacuation. For example, workers who enter a tank, boiler, or tunnel must continuously monitor the atmosphere to detect flammable vapors or poisonous gases, and they must immediately exit if such dangerous conditions arise. Similarly, workers who are employed in welding, cleaning, or painting operations and work in a confined space must immediately evacuate if a fire breaks out, filling the confined space with dangerous gases and smoke. In addition, personnel at disaster sites, such as buildings that have been partially collapsed from earthquakes, fires, or bombings, must evacuate immediately if the building shows signs of further collapse. In these circumstances, it is desirable for an exit beacon device to emit no sound until an emergency condition is detected. When such an emergency condition is detected, a radio signal may be sent to the exit beacon by an automatic detector or by a worker in charge of safety, triggering the unit's operation and allowing workers to find their way to a safe exit.

Although the present invention has been described with reference to certain preferred embodiments, other embodiments are possible. Therefore, the spirit and scope of the appended claims should not be limited to the preferred embodiments contained in this description.

I claim:

1. A portable audible beacon comprising:

a housing;

a signal generating means mounted in the housing for generating an oscillating signal that is periodically interrupted by a zero signal, where the fundamental frequency of the oscillating signal corresponds to a frequency of high auditory sensitivity to the human ear either greater than or equal to 2000 Hz, where the frequency of interruption of the oscillating signal corresponds to a directionally discernible frequency to the human ear less than 2000 Hz, and where the period of duration of each zero signal is either less than or about the same as the period of duration of the oscillating signal between each zero signal; and an acoustic transducer mounted in the housing for receiving the signal generated by the signal generating means and for converting it into sound.

2. The portable audible beacon of claim 1, further comprising a power source mounted in the housing.

3. The portable audible beacon of claim 2, in which the power source is rechargeable.

4. The portable audible beacon of claim 1, in which the oscillating signal has a fundamental frequency between the range of 2000 Hz to 3000 Hz.

5. The portable audible beacon of claim 4, in which the frequency of interruption of the oscillating signal is 50 Hz to 500 Hz.

6. The portable audible beacon of claim 5, in which the frequency of the oscillating signal is 2500 Hz, the frequency of interruption of the oscillating signal is 125 Hz, the period of duration of each zero signal is 0.0004 second, and the period of duration of the oscillating signal between each zero signal is 0.0076 second.

7. The portable audible beacon of claim 1, further comprising a strobe light and a carrying handle mounted on the top of the housing.

8. The portable audible beacon of claim 1, in which the housing contains a plurality of panels with at least one panel having a grille portion with a plurality of holes for the passing of sound.

9. The portable audible beacon of claim 8, in which a standoff handle is mounted on one of the panels having a grille portion, the standoff handle having a height that prevents the portable audible beacon from being placed down on the panel on which the standoff handle is mounted on a substantially level surface without tipping over.

10. The portable audible beacon of claim 9, in which the standoff handle is mounted diagonally across the panel.

11. The portable audible beacon of claim 1, further comprising a waterproof, flexible, heat-resistant membrane enclosing the acoustic transducer allowing the transducer to operate when the transducer is partially submerged in water.

12. The portable audible beacon of claim 11, in which the membrane consists of a film of polyvinylidene fluoride of a thickness ranging from 0.5 mil to 1 mil.

13. The portable audible beacon of claim 1, further comprising a radio receiving means mounted in the housing for controlling the operation of the signal generating means.

14. The portable audible beacon of claim 1, wherein the period of duration of each zero signal is less the period of duration of the oscillating signal between each zero signal.

15. The portable audible beacon of claim 14, wherein the period of duration of each zero signal is equal to one or more periods of the fundamental frequency of the oscillating signal.

16. A portable audible beacon comprising:

a housing;

a signal generating means mounted in the housing for generating a periodic control signal; and an acoustic transducer mounted in the housing for receiving the periodic control signal and converting it into a periodic audible signal, each cycle of the periodic audible signal comprised of a plurality of periods of a directionally perceptible sound alternated with approximately equal periods of silence, and followed by a period of silence of sufficient duration to allow the hearing of voice commands or calls for help; and wherein each period of the plurality of periods of the directionally perceptible sound is comprised of sound having a fundamental frequency interrupted by silence, where the fundamental frequency corresponds to a frequency of high auditory sensitivity to the human ear either greater than or equal to 2000 Hz, where the frequency of interruption by silence corresponds to a directionally discernible frequency of less than 2000 Hz, and where each duration of silence between the sound of the fundamental frequency is either less than or about the same as each duration of the sound of the fundamental frequency.

17. The portable audible beacon of claim 16, in which each cycle of the periodic audible signal is comprised of four, one-quarter second periods of a directionally perceptible sound alternated with four, one-quarter second periods of silence, and followed by an eight second period of silence.

18. A portable audible beacon comprising:

a housing with a plurality of panels, with at least one panel having a grille portion with a plurality of holes for the passing of sound;

a signal generating means mounted in the housing for generating a control signal;

an acoustic transducer mounted in the housing for receiving the control signal and for converting it into a directionally perceptible sound;

a standoff handle mounted on one of the panels having a grille portion, the standoff handle having a height that prevents the portable audible beacon from being placed down on the panel on which the standoff handle is mounted on a substantially level surface without tipping over.

19. A portable audible beacon comprising:

a housing;

a signal generating means mounted in the housing for generating a control signal;

an acoustic transducer mounted in the housing for receiving the control signal and for converting it into a directionally perceptible sound; and a waterproof, watertight, airtight, flexible, heat-resistant membrane enclosing the entire acoustic transducer within the housing, the enclosed membrane preventing water from entering therein and containing air therein for allowing the transducer to operate when the transducer is partially submerged in water.

20. A portable audible beacon comprising:

a housing;

a radio receiving means mounted in the housing for receiving a radio signal;

a signal generating means mounted in the housing for generating a first control signal and a second control signal;

a switching means mounted in the housing controlled by the radio receiving means for switching between the first and second control signals;

an acoustic transducer mounted in the housing for receiving the output signal of the switching means and for converting it into a directionally perceptible sound, such that when the first control signal is received by the acoustic transducer, the acoustic transducer produces a first directionally perceptible sound and when the second control signal is received by the acoustic transducer, the acoustic transducer produces a second directionally perceptible sound that is distinctly different from the first directionally perceptible sound, each of the first and second directionally perceptible sounds comprising a fundamental frequency corresponding to a frequency of high auditory sensitivity to the human ear that is interrupted by silence, the frequency of interruption by silence corresponding to a directionally perceptible frequency to the human ear, each duration of silence being either less than or about the same as each duration of sound of high auditory sensitivity.

* * * * *